United States Patent [19]

Edwards

[11] 4,324,111

[45] Apr. 13, 1982

[54] FREEZING GEL CONTAINMENT STRUCTURE AND METHOD

[75] Inventor: William A. Edwards, Los Angeles, Calif.

[73] Assignee: Jerry B. Gallant, Tarzana, Calif.

[21] Appl. No.: 160,858

[22] Filed: Jun. 19, 1980

[51] Int. Cl.[3] ..... F25D 3/08

[52] U.S. Cl. ..... 62/457; 53/410; 62/530

[58] Field of Search ..... 62/457, 530; 53/410, 53/472, 49; 215/12 R; 150/52 R; 156/80

[56] References Cited

U.S. PATENT DOCUMENTS

| | | | |
|---|---|---|---|
| 2,547,886 | 4/1951 | Poux | 62/530 |
| 2,589,577 | 3/1952 | Rosenthal et al. | 62/530 X |
| 2,993,313 | 7/1961 | Hogan | 53/410 |
| 3,262,283 | 7/1966 | Taylor | 62/530 X |
| 3,282,068 | 11/1966 | Cain | 62/457 |
| 4,183,226 | 1/1980 | Moore | 62/457 |

FOREIGN PATENT DOCUMENTS

| | | | |
|---|---|---|---|
| 1401600 | 10/1968 | Fed. Rep. of Germany | 62/457 |
| 1018835 | 1/1953 | France | 62/530 |

*Primary Examiner*—Lloyd L. King
*Attorney, Agent, or Firm*—Allan M. Shapiro

[57] ABSTRACT

Freezing gel containment structure is comprised of a plurality of adjacent tubes. The tubes are secured in adjacent edgewise relationship and each is separately filled with freezing gel. The tubes are tall and narrow and are sufficiently filled so that they have some cylindrical structural strength. The containment structure comprised of the plurality of tubes is strong enough to stand.

14 Claims, 9 Drawing Figures

FIG. 1
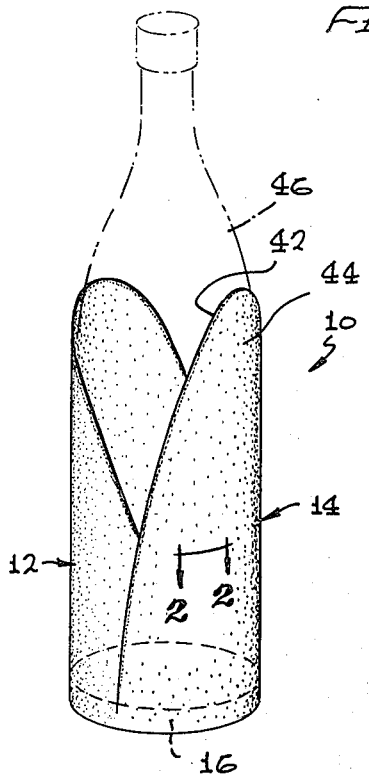
FIG. 4
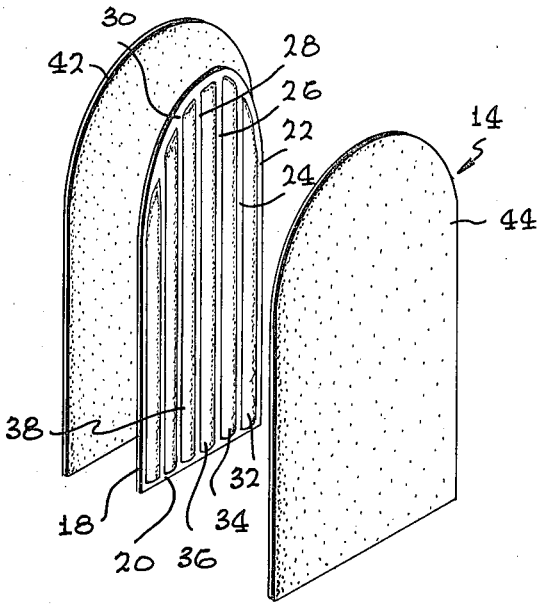
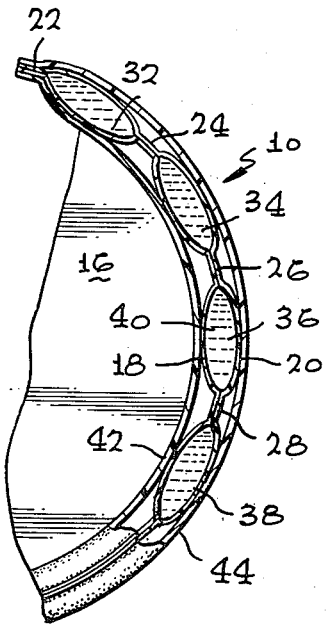
FIG. 2
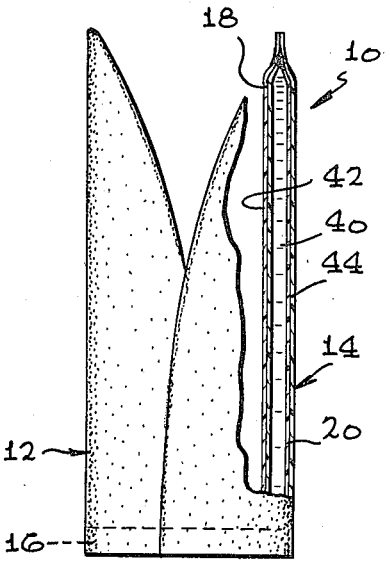
FIG. 3
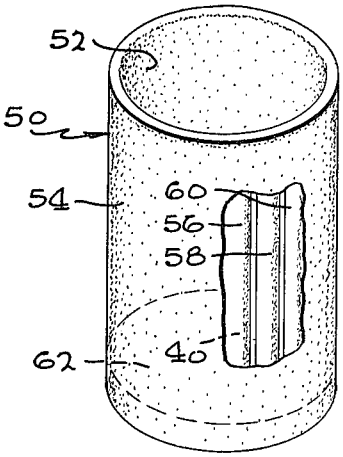
FIG. 5

FIG. 6
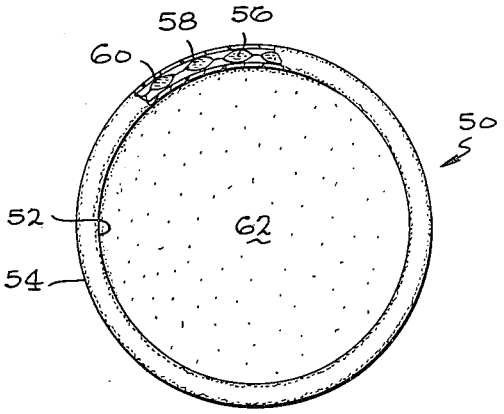
FIG. 9
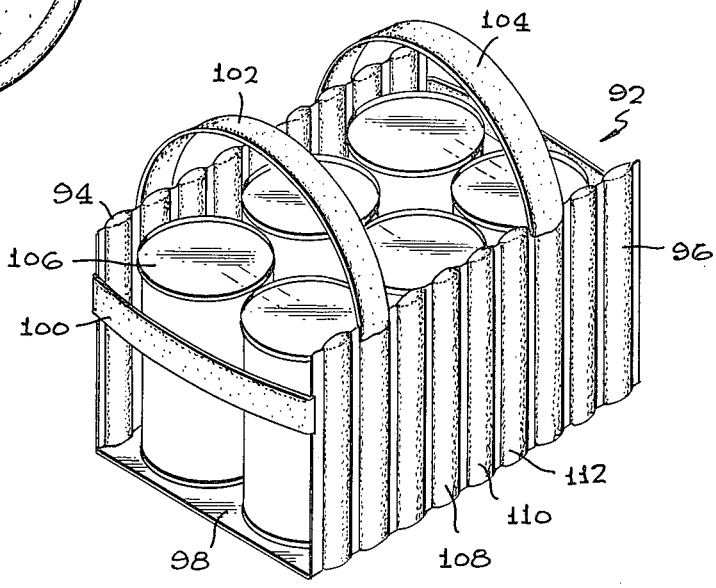
FIG. 8
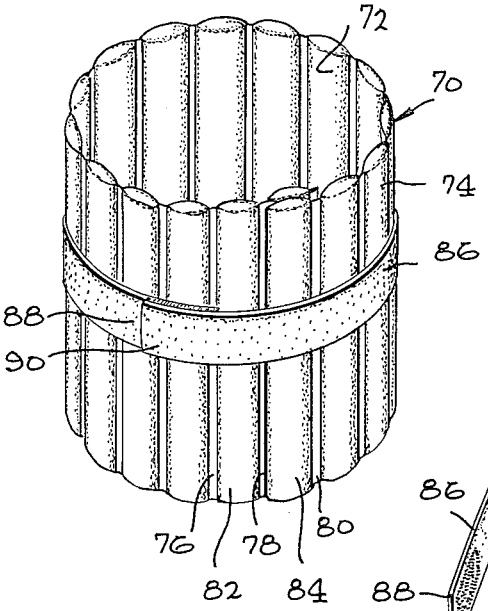
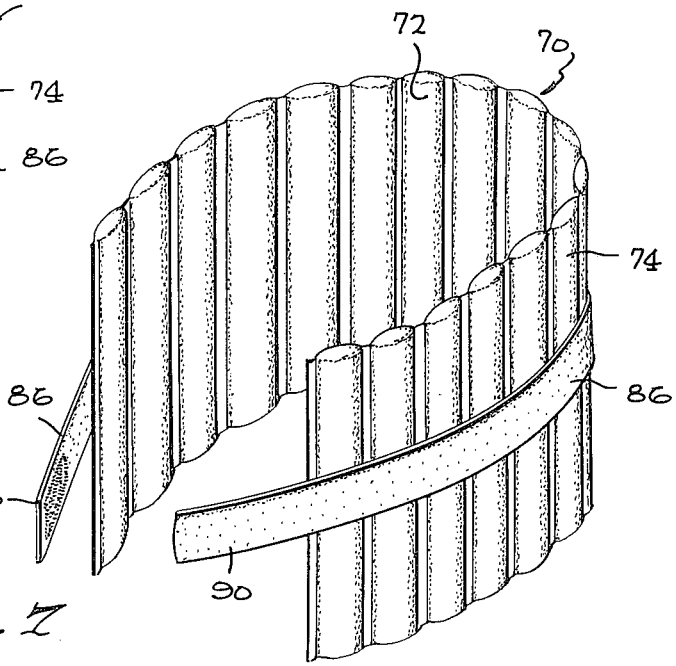
FIG. 7

FREEZING GEL CONTAINMENT STRUCTURE AND METHOD

BACKGROUND OF THE INVENTION

There exist many gels which can be cooled to freezing and which absorb heat during warmup. These gels are placed in sealed envelopes or pockets and are employed as a reuseable coolant for portable iceboxes and the like. There are a number of different types of such gels. Some of them freeze solid, and some are flexible even at 0 degrees F. Such gels are usually packaged in a vinyl or other synthetic polymer composition flexible material so that the gel does not escape at any time. These freezing gel packages can be reused many times. They can only be employed as coolant in an icebox because of the size and shape of the envelope structures. The envelopes in which the gels are enclosed are of fairly large dimension so that they must be laid flat in the freezer or they will slump into a shape which is difficult to use in the icebox. There has been no constraint of the gel other than to prevent it from escaping the envelope.

SUMMARY OF THE INVENTION

In order to aid in the understanding of this invention, it can be stated in essentially summary form that it is directed to a freezing gel containment structure and method wherein narrow tubes are made of flexible material and are attached to each other and are sufficiently filled with gel so that they have adequate structural strength to stand, even in warm condition. The method comprises forming such a containment structure, cooling it and placing it around material to be cooled.

It is thus an object of this invention to provide a freezing gel containment structure which has sufficient structural rigidity that it can be wrapped around material to be cooled and to maintan itself in an upright position around the material. It is another object to provide a freezing gel containment structure which comprises a plurality of tubes made of flexible material, with each tube being filled with freezing gel sufficiently to provide structural strength. It is a further object to provide a method whereby freezing gel can be contained and positioned around food material to be cooled so that the food material can be cooled or maintained in a cool position, even away from other types of refrigeration.

The features of the present invention which are believed to be novel are set forth with particularity in the appended claims. The present invention, both as it its organization and manner of operation, together with further objects and advantages thereof, may be best understood by reference to the following description, taken in conjunction with the accompanying drawings.

BRIEF DESCRIPTION OF THE DRAWINGS

FIG. 1 is a perspective view of the freezing gel containment structure in a preferred embodiment, shown in conjunction with food material to be cooled.

FIG. 2 is an enlarged section as seen generally along the line 2—2 of FIG. 1, with parts broken away.

FIG. 3 is an enlarged side-elevational view of the structure of FIG. 1.

FIG. 4 is an isometric view of one of the panels of the structure of FIGS. 1 through 3 shown in a to be assembled position.

FIG. 5 is a perspective view, with parts broken away, of another preferred embodiment of the freezing gel containment structure of this invention.

FIG. 6 is a plan view of the structure of FIG. 5, with parts broken away.

FIG. 7 is a perspective view of another preferred embodiment of the freezing gel containment structure of this invention, shown in the open position.

FIG. 8 is a perspective view of the structure of FIG. 7, in the closed position.

FIG. 9 is another preferred embodiment of the freezing gel containment structure of this invention, shown as a 6-pack cooler.

DESCRIPTION OF THE PREFERRED EMBODIMENTS

The first preferred embodiment of the freezing gel containment structure of this invention is generally indicated at 10 in FIGS. 1, 2 and 3. Containment structure 10 comprises first and second panels 12 and 14 secured to circular base 16. Panel 14 is shown in FIG. 4 at an intermediate stage of construction. Panels 12 and 14 are the same, and since panel 14 is shown in more detail in FIGS. 2, 3 and 4, it will be explained in detail below. Panel 14 comprises first and second sheets 18 and 20 of synthetic polymer composition material, preferably a material which is flexible at freezing temperatures, and will contain a freezing gel. Furthermore, a thermoplastic is preferable so that it can be heat-sealed. The sheet material, known as polyvinyl, is suitable for this purpose. The first and second sheets 18 and 20 of the flexible material are cut into a suitable shape, and in the present example, each sheet is rectangular in a tall or upright direction, with a semi-oval or semi-circular top edge. The sheets are sealed together at the edges and in parallel upright seal lines. Edge seal 22 and intermediate seals 24, 26, 28 and 30 are shown in FIGS. 2 and 4. These seals define a plurality of upright tubes, of which tubes 32, 34, 36 and 38 are also seen in these figures. This number of tubes is illustrative, and there are enough tubes to reach from edge-to-edge of the panels, and the tubes are sufficiently narrow that they can form individual tubular structural members.

Freezing gel 40 is filled into the tubes at one end before they are completely sealed, and after the filling, the tubes are sealed off to retain the freezing gel. Freezing gel 40 is illustrated in one of the tubes in FIGS. 2 and 3 and is of conventional nature. It is preferably of material which changes state at 30 to 40 degrees F. and requires considerable heat energy as it warms through this change of state so that it serves as an artificial ice or serves as a medium which absorbs heat from its surroundings to maintain its surrounds at a lower temperature level than would otherwise be available. Such gels are conventional and are well-known. Some of them are solid in the chilled state, and some are pliable. A pliable freezing gel is preferable for use in connection with the containment structure of this invention. When filled with the freezing gel, the tubes are sufficiently filled so that even in the warm state each of the tubes serves as a structural member which is sufficiently stiff that it will stand upright by itself. When a plurality of such tubes is filled and adjacent each other, they form a self-supporting panel as indicated in FIGS. 1 and 3.

After the filling of the tubes, the tubes can be encased in covers 42 and 44, if desired. The covers are preferably decorative and hide the utilitarian structural appearance of the filled tubes. The covers may carry printed indicia of words, numbers or designs. In accordance with the first preferred embodiment, the containment structure has its panels 12 and 14 secured to the circular base 16. The circular base 16 is of such size as to receive a bottle 46 therein so that the bottle can be cooled or maintained in a cool condition. The bottle may contain a food material or another material that will benefit from chilling. The diameter of circular base 16 is suitable or a small range in bottle diameter, and it is for this reason that a flexible (when chilled) freezing gel is desired. The structure illustrated in FIGS. 1 and 3 is sufficiently rigid that in the warm condition it will stand in the configuration illustrated, and in that configuration, can be placed in a freezer for chilling. After freezing, it has the desired configuration for the receipt of bottle 46.

The containment structure 50 in FIGS. 5 and 6 is the second preferred embodiment of the containment structure of this invention. It has an inner cover 52 and an outer cover 54, both of cylindrical tubular shape. They are preferably of a flexible polymer composition material and are preferably decorative in nature. Between the tubular structure of the inner and outer covers are positioned a plurality of freezing gel tubes, three of which are seen at 56, 58 and 60. These freezing gel tubes are formed in the same way as the tubes formed in sheets 18 and 20 in the structure 10. The freezing gel tubes are thus parallel tubes in between two layers of heat-sealable, flexible thermoplastic sheet and are filled with a freezing gel the same as freezing gel 40. The diameter of the inner cover 52 is such as to receive a beverage can, and the height is such that the beverage can is substantially all received within containment structure 50. In this way, a beverage can can be maintained in the cooled condition by first chilling both the beverage can and the containment structure 50. The bottom 62 can be a flexible or rigid construction. Preferably, the bottom 62 is rigid so as to maintain the structure 50 in a circular condition at all times. On the other hand, since the freezing gel 40 is flexible so that it can adapt itself around a beverage can, the bottom 62 need not be rigid, but can be a layer of flexible material. On the other hand, it can also be a pocket between two such layers of flexible material, with the pocket carrying some freezing gel therein.

FIGS. 7 and 8 illustrate freezing gel containment structure 70 which is another preferred embodiment of the containment structure of this invention. Containment structure 70 is a panel comprised of inner and outer sheets 72 and 74 of flexible heat-sealable thermoplastic synthetic polymer composition material which can be formed to retain a freezing gel. The inner and outer sheets are sealed together along their edges and along parallel upright intermediate seams to define a plurality of upright tubes. Intermediate seams 76, 78 and 80 are illustrated in FIGS. 7 and 8, and they define tubes 82 and 84 which are examples of the plurality of upright tubes illustrated in these figures. All of the tubes are upright, and all of the intermediate seams are upright so that the tubes are flexible with respect to each other along the axes determined by the intermediate seams. Each of the tubes is filled with a freezing gel such as the gel 40.

Strap 86 is secured to the outside of panel 74 and has its ends 88 and 90 extending beyond the panel formed of sheets 72 and 74. The freezing gel sufficiently fills the tubes of panel structure 70 so that they are individually self-supporting to maintain thermselves in a substantially straight orientation. The seal joints between the tubes in the panel are such that the panel is flexible even at chilled temperatures so that the structure 70 can bend around an axis parallel to the tubes so that it can embrace a container, such as a circular beverage container, either a bottle or a can. The ends 88 and 90 of the strap have attachment means thereon, such as Velcro so that, when the structure is embraced around a container, it can be strapped tight thereon. In this way, the beverage container can be maintained in a cool condition. The advantage of the structure 70 is that it can wrap around and closely embrace and be retained on beverage containers of different diameters.

The containment structure 92 is another preferred embodiment of the freezing gel containment structure of this invention. It comprises a rectangular structure having sidewalls 94 and 96 and bottom 98. Ends in the fomr of straps, such as strap 100, hold the sides in an upright position. Carrying straps 102 and 104 embrace the sides 94 and 96 and extend around or attach to the bottom 98. A rectangular open top structure is defined, into which a 6-pack of beverage containers 106 can be inserted. The sidewalls 94 and 96 are formed in the same way as the above described panels, which are comprised of narrow tubes of flexible thermoplastic synthetic polymer composition material filled with a freezing gel. Tubes 108, 110 and 112 are illustrated, so that each of the sides 94 and 96 is one of the above-described panels. As described, the panels have tubes which are sufficiently narrow with respect to their height and are sufficiently filled with the freezing gel that they are self-supporting. Bottom 98 can also be such a panel, if desired, and the end straps, instead of being narrow straps, can be full-sized ends in the form of such panels of tubes containing freezing gel. In this way, the beverage containers and the containment structure 92 can be chilled so that the containment structure maintains the beverage containers cooled for a substantial length of time.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A freezing gel containment structure comprising:

first and second sheets of flexible thermoplastic synthetic polymer composition material, said sheets lying in a substantially face-to-face relationship, said sheets being sealed together adjacent their adges and being sealed together at intermediate parallel upright seal lines to form a plurality of adjacent upright tubes, said tubes having freezing gel therein, said tubes being sufficiently narrow in a direction transverse to the upright direction with respect to their height in the upright direction and being sufficiently filled with freezing gel that each of said tubes is self-supporting when standing in the upright direction, said sheets with said tubes and said freezing gel filling forming a panel which will stand in the upright direction and which is flexible along said intermediate seal lines so that it is bendable around an upright axis.

2. The freezing gel containment structure of claim 1 wherein said panel is sufficiently long in a direction at right angles to the upright direction to extend around a beverage container.

3. The freezing gel containment structure of claim 2 wherein a strap is positioned around said panel, said strap having ends fastenable together so that said panel can be maintained and embrace around a beverage container for the freezing.

4. The freezing gel containment structure of claim 2 wherein said panel is tubularly configured to embrace around a beverage container.

5. The freezing gel containment structure of claim 1 wherein there are first and second of said panels, said first and second panels being positioned to fit on opposite sides of at least one beverage container.

6. The freezing gel containment structure of claim 5 wherein said first and second panels are both connected to a base so that said panels are maintained in spaced relationship with respect to each other.

7. The freezing gel containment structure of claim 6 wherein said base is circular and is of substantially the same diameter as a beverage container so that said panels are maintained in a circular orientation with said tubes extending upright from said base so that a circular beverage container can be received therein.

8. The freezing gel containment structure of claim 7 wherein the upper edges of said panels are curved.

9. The freezing gel containment structure of claim 1 wherein a cover sheet is positioned one one side of said panel so as to cover said tubes.

10. A freezing gel containment structure comprising;

first and second flexible thermoplastic synthetic polymer composition material sheets lying adjacent each other in substantially face-to-face relationship;

edge seals between said sheet around the edges thereof to seal said sheets together adjacent their edges, said sheets having an upright direction and a lateral direction at right angles thereto;

a plurality of intermediate seals lines between said sheets in an upright direction to define a plurality of tubes between said sheets in an upright direction, said tubes being long in the upright direction as compared with the width thereof in the lateral direction;

feeezing gel within said tubes to form a panel, said freezing gel sufficiently filling said tubes so that said panel is self-supporting in the upright direction; and means for securing said panel around a beverage container in a direction such that the upright direction of said panel extends in the upright direction of the container so that, upon precooling of said freezing gel containment structure, the beverage container can be maintained cool by said containment structure.

11. The freezing gel containment structure of claim 10 wherein there is a cover attached to said panel on the outside thereof so that said cover aids as a thermal insulator and as a means to decorate said containment structure.

12. The method of making a freezing gel containment structure comprising the steps of:

placing first and second sheets of flexible thermoplastic synthetic polymer composition material adjacent each other in substantially face-to-face relationship;

heat-sealing the sheets together around adjacent their edges and along intermediate seal zones substantially parallel to each other and in an upright direction to form tubes between the intermediate seal zones and to form flexible spaces between the tubes along the intermediate seal zones;

filling the tubes substantially full of freezing gel so that, when filled and sealed and stood in the upright direction, the tubes are substantially rigid and self-supporting to form a panel while the panel remains flexible along the intermediate seal zones so that the panel can be wrapped about a curved beverage container; and providing attachment means attached to the panel for holding the panel in embrace around a beverage container.

13. The method of using the containment structure of claim 12 including the steps of:

placing the freezing gel containment structure in the upright position in a cooler for cooling the freezing gel therein;

removing the panel from the cooler; and embracing the panel around a beverage container to be cooled.

14. The method of using the freezing gel containment structure of claim 13 further including the step of placing the beverage container in a cooler and removing it therefrom before the step of embracing the beverage container with containment structure.

* * * * *